US005279004A

United States Patent [19]

Walker

[11] Patent Number: 5,279,004

[45] Date of Patent: Jan. 18, 1994

[54] HANDICAP BATHTUB LIFT APPARATUS

[76] Inventor: Wonathan L. Walker, 4181 129th Place SE. #X304, Bellevue, Wash. 98006

[21] Appl. No.: 27,435

[22] Filed: Mar. 8, 1993

[51] Int. Cl.[5] ..... A47K 3/12

[52] U.S. Cl. ..... 4/563.1; 4/561.1; 297/DIG. 10; 414/921

[58] Field of Search ..... 4/560.1, 561.1, 562.1, 4/563.1, 564.1, 565.1, 566.1; 414/921; 5/85.1, 87.1, 83.1; 297/345, 344, 347, DIG. 10

[56] References Cited

U.S. PATENT DOCUMENTS

| | | | |
|---|---|---|---|
| 3,286,970 | 11/1966 | Nolan | 4/564.1 |
| 3,981,484 | 9/1976 | James | 414/921 |
| 4,221,008 | 9/1980 | Nolan | 4/563.1 |
| 4,598,432 | 7/1986 | Pennington-Richards | 4/563.1 |
| 4,633,538 | 1/1987 | James | 414/921 |
| 4,733,418 | 3/1988 | Luther | 4/562.1 |
| 4,905,327 | 3/1990 | Boubil | 4/562.1 |

*Primary Examiner*—Henry J. Recla
*Assistant Examiner*—Charles R. Eloshway
*Attorney, Agent, or Firm*—Leon Gilden

[57] ABSTRACT

A bathtub lift employing a hydraulic cylinder reciprocatably mounted about an elongate shaft has the cylinders mounting a seat member thereto, wherein a valve member is arranged for operative filling of an upper chamber within the cylinder to effect lifting of the chair and specifically permitting exhausting of fluid from the cylinder to permit lowering of the chair within a bathtub as the cylinder is rotatably mounted about the shaft.

5 Claims, 6 Drawing Sheets

HANDICAP BATHTUB LIFT APPARATUS

BACKGROUND OF THE INVENTION

1. Field of the Invention

The field of invention relates to lift chair structure, and more particularly pertains to a new and improved handicap bathtub lift apparatus wherein the same is arranged to permit lifting of a handicapped individual within a bathtub organization.

2. Description of the Prior Art

Bathtub lift structure, particularly for handicapped individuals, is available in the prior art and exemplified by U.S. Pat. No. 4,928,330 employing an electric drive motor arranged to lift a housing about a central shaft.

The instant invention attempts to overcome deficiencies of the prior art by providing for a central shaft utilizing a lifting cylinder, wherein the lifting cylinder is in operative communication with hydraulic fluid and may employ water pressure to eliminate the use of electrical appliances relative to a bathtub structure providing for a safe environment for use of the chair relative to a bathtub and in this respect, the present invention substantially fulfills this need.

SUMMARY OF THE INVENTION

In view of the foregoing disadvantages inherent in the known types of handicap bathtub lift apparatus now present in the prior art, the present invention provides a handicap bathtub lift apparatus wherein the same employs a hydraulic cylinder reciprocatably and rotatably mounted relative to a central shaft to permit lifting of a chair structure mounted to the cylinder. As such, the general purpose of the present invention, which will be described subsequently in greater detail, is to provide a new and improved handicap bathtub lift apparatus which has all the advantages of the prior art handicap bathtub lift apparatus and none of the disadvantages.

To attain this, the present invention provides a bathtub lift employing a hydraulic cylinder reciprocatably mounted about an elongate shaft with the cylinders mounting a seat member thereto, wherein a valve member is arranged for operative filling of an upper chamber within the cylinder to effect lifting of the chair and specifically permitting exhausting of fluid from the cylinder to permit lowering of the chair within a bathtub as the cylinder is rotatably mounted about the shaft.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved handicap bathtub lift apparatus which has all the advantages of the prior art handicap bathtub lift apparatus and none of the disadvantages.

It is another object of the present invention to provide a new and improved handicap bathtub lift apparatus which may be easily and efficiently manufactured and marketed.

It is a further object of the present invention to provide a new and improved handicap bathtub lift apparatus which is of a durable and reliable construction.

An even further object of the present invention is to provide a new and improved handicap bathtub lift apparatus which is susceptible of a low cost of manufacture with regard to both materials and labor, and which accordingly is then susceptible of low prices of sale to the consuming public, thereby making such handicap bathtub lift apparatus economically available to the buying public.

Still yet another object of the present invention is to provide a new and improved handicap bathtub lift apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
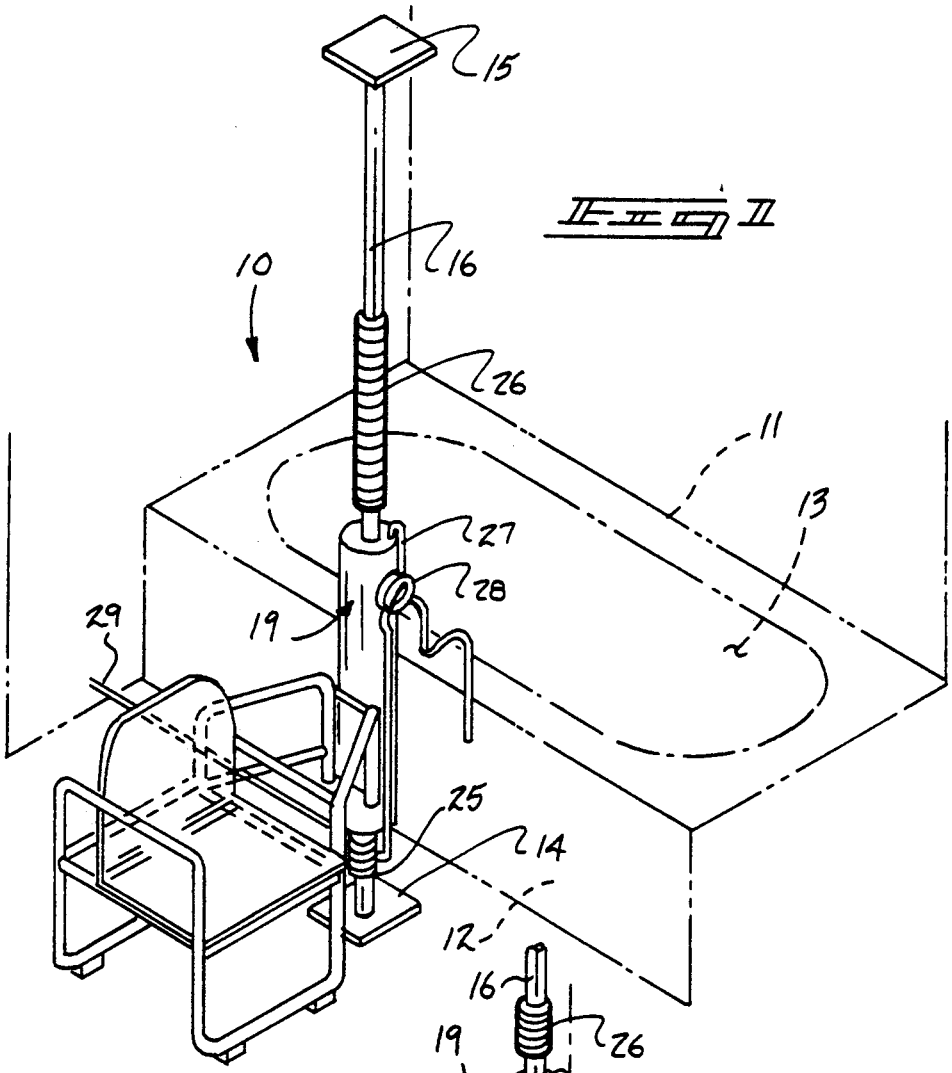
FIG. 1 is an isometric illustration of the invention in a lowered orientation.

With reference now to the drawings, and in particular to FIG. 1 to 11 thereof, a new and improved handicap bathtub lift apparatus embodying the principles and concepts of the present invention and generally designated by the reference numeral 10 will be described.

More specifically, the handicap bathtub lift apparatus 10 of the instant invention essentially comprises cooperation with a bathtub 11, that includes a bathtub side wall 12 and a bathtub cavity 13 to receive an individual. The apparatus 10 includes a foot plate 14 spaced from a head plate 15 having a longitudinal shaft 16 directed fixedly therebetween. The shaft 16 may be of a telescoping construction as required to secure the shaft in a vertical orientation in adjacency to the bathtub side wall 12. A piston plate 17 is fixedly mounted to the shaft member 16, having a peripheral fluid seal 18 directed about the piston plate 17. The piston plate 17 is contained within a reciprocatable cylinder 19 that is divided into a cylinder upper chamber 19*a* and a cylinder lower chamber 19*b* (see FIG. 8 and FIG. 9 for example), wherein the upper chamber 19*a* is oriented between the piston plate 17 and a cylinder top wall 21, while the cylinder lower chamber 19*b* is oriented between the piston plate 17 and the cylinder bottom wall 20. The cylinder having a cylinder side wall 22 including a lug 23 fixedly mounted to the side wall 22, with the lug including a mounting wall 24 substantially parallel to the shaft 16. A first protective bellows 25 extends between the cylinder 19 adjacent the bottom wall 20 and the foot plate 14, while a second protective bellows 26 extends from the cylinder top wall 21 to position either in engaging or in adjacency to the head plate 15 to afford protection to an individual preventing an individual contact with the cylinder's engagement with the shaft 16 as the cylinder reciprocates along the shaft.

A control valve 28 is provided mounted to the cylinder, or alternatively arranged for securement by an individual, with the control valve including a first port 27*a*, a second port 29*a*, and a third port 30*a* directed through the valve housing 38 of the control valve 28. A hydraulic cylinder conduit 27 is directed from the first port 27*a* through the cylinder top wall 21 into the upper chamber 19*a*. A pressure conduit 29 directing fluid from any convenient pressure source, such as household pressurized water, directs water from the pressure conduit 29 into the second port 29*a*, while a fluid exhaust conduit 30 in communication with the third port 30*a* directs fluid from the exhaust port 30, and typically into the bathtub cavity 13. It may be understood that other mediums may be employed other than household fluid, such as hydraulic fluid and pneumatic pressure but for convenience, household fluid is most readily employed in association with the organization.

When directing fluid from the pressure conduit 29*a* into the cylinder conduit 27, fluid is thereby directed when the rotary valve hub 31 is in the first position. The rotary valve hub includes a hub first conduit and a hub second conduit 32 and 33 respectively that are spaced apart one hundred twenty degrees. It should be noted that first, second, and third ports 27*a*, 29*a*, and 30*a* are also spaced apart one hundred twenty degrees relative to one another. In the first position, the rotary hub 31 communicates the first and second ports to direct fluid into the upper chamber 19*a* to effect raising of the cylinder into a second position from a first position relative to the FIGS. 1 and 2. Upon rotating the hub 31 to a second position communicating the first port 27*a* with the third port 30*a* in communication with the exhaust conduit 30*a*, fluid is expelled due to the weight of individuals sitting upon the seat portion of the organization. To provide for proper alignment of the hub relative to the first and second positions, as illustrated in the FIG. 5 for example, an arcuate slot 37 is directed into an interior wall of the valve housing 38, wherein the arcuate slot 37 receives a tang 36 that is mounted to the hub 31. The tang when in engagement with the first end of the arcuate slot 37 aligns in fluid communication the first and second ports 27*a* and 29*a* through the hub first and second conduits 32 and 33, while rotating the hub 31 to the second position positioning the tang at a second end of the slot 37 effects fluid communication of the first and third ports 27*a* and 30*a* through the hub first and second conduits 32 and 33 respectively.

Figure 2:
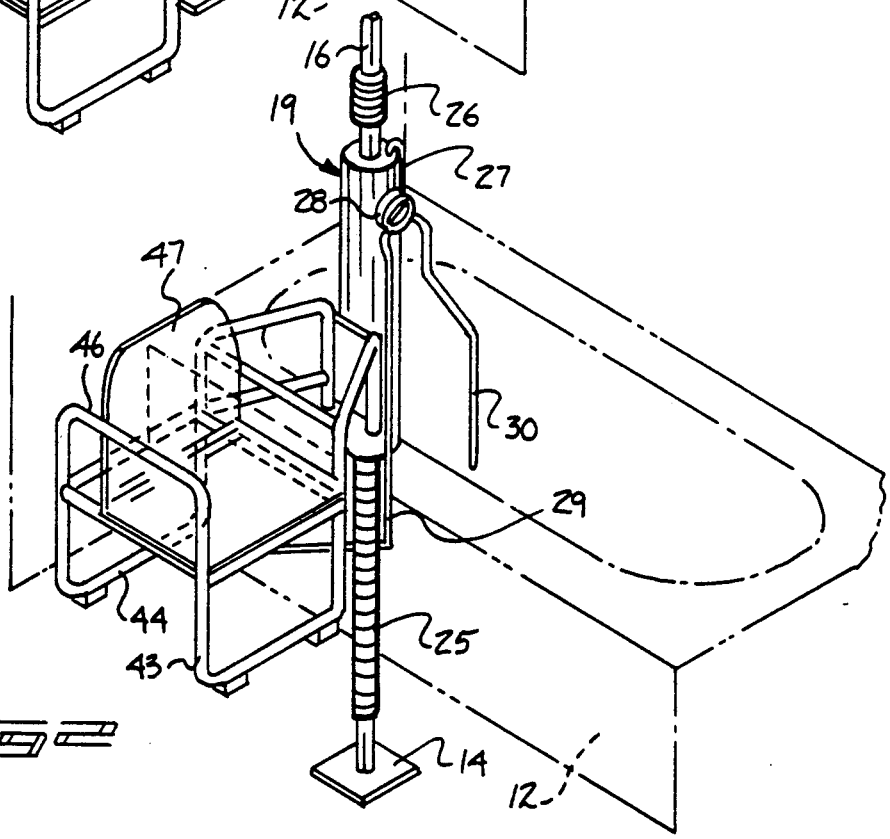
FIG. 2 is an isometric illustration of the invention in a raised orientation of the chair structure.
Figure 3:
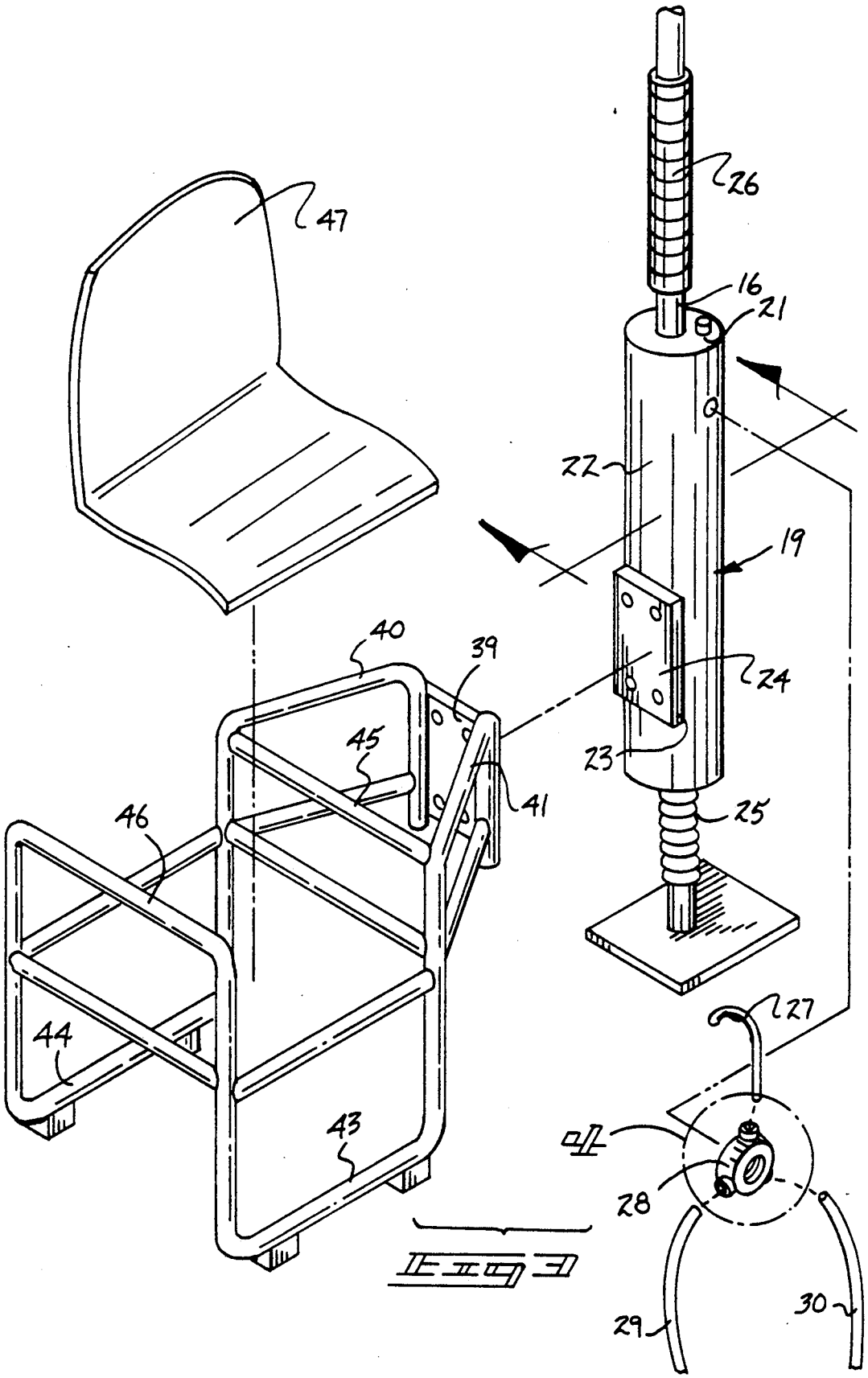
FIG. 3 is an isometric exploded view of the hydraulic cylinder in association with the chair lift bracket.
Figure 4:
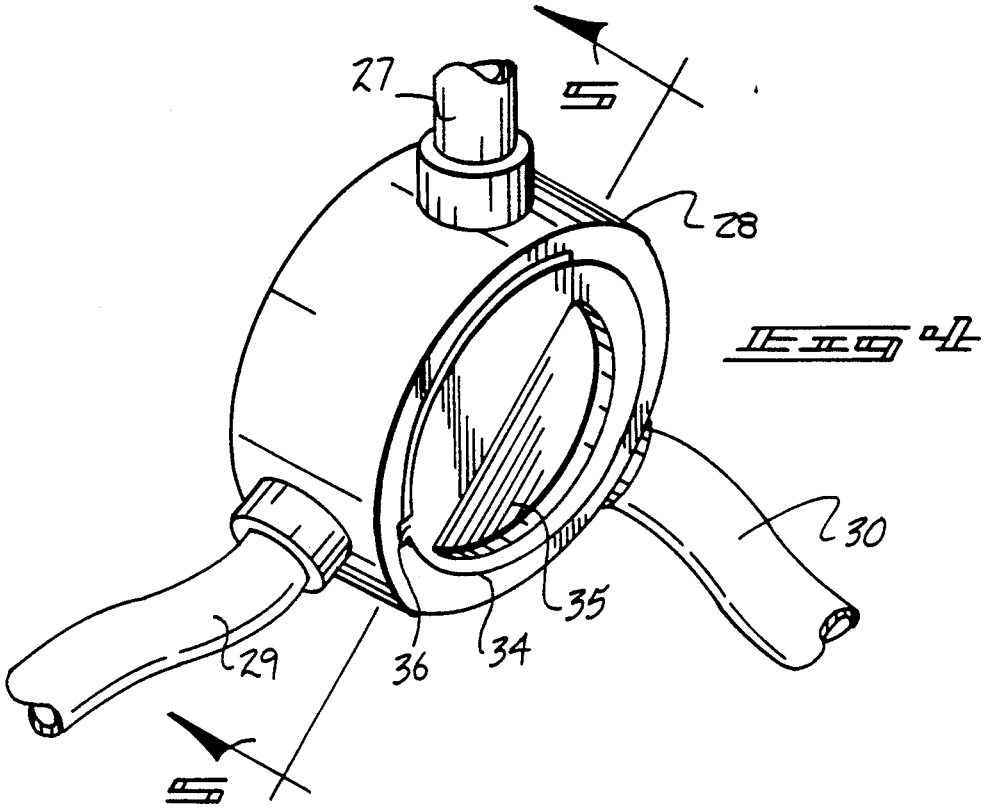
FIG. 4 is an enlarged isometric illustration of section 4 as set forth in FIG. 3.
Figure 5:
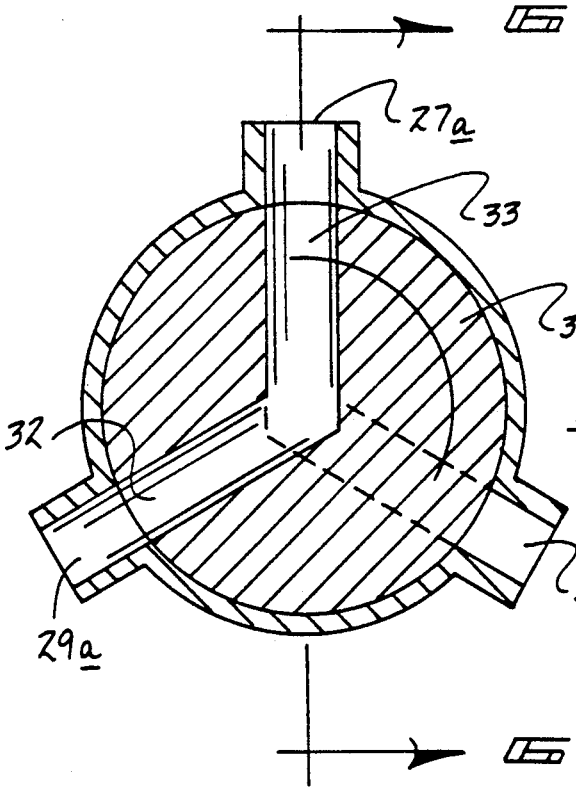
FIG. 5 is an orthographic view, taken along the lines 5—5 of FIG. 4 in the direction indicated by the arrows.
Figure 6:
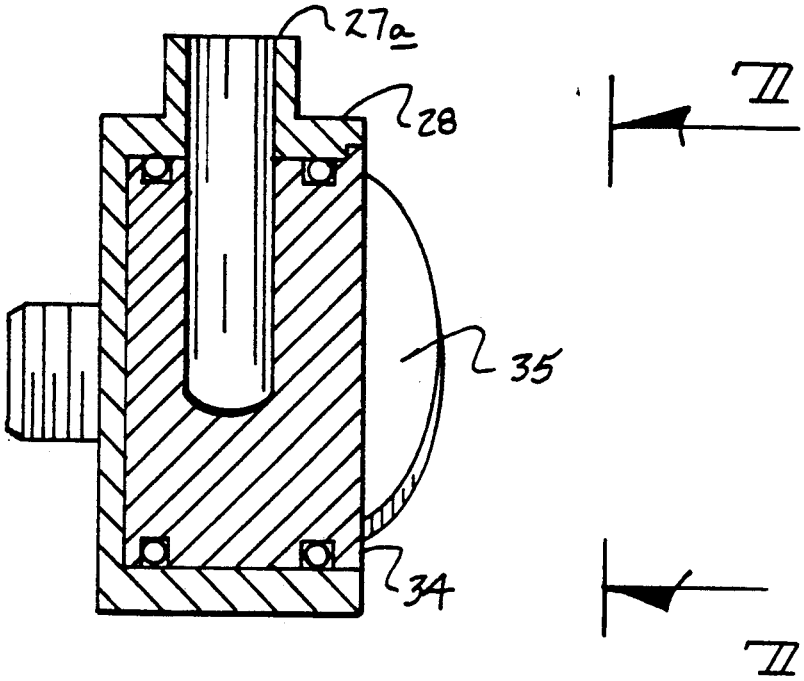
FIG. 6 is an orthographic view, taken along the lines 6—6 of FIG. 5 in the direction indicated by the arrows.
Figure 7:
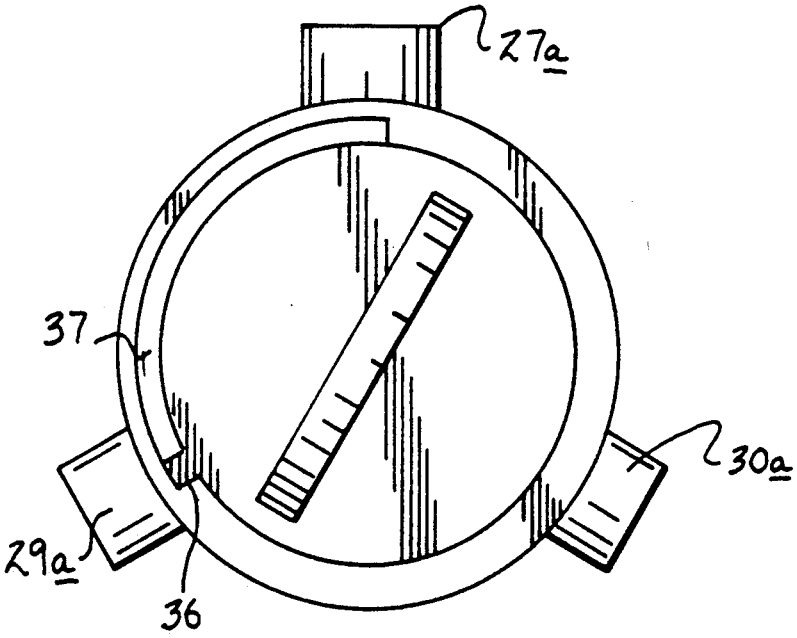
FIG. 7 is an orthographic view, taken along the lines 7—7 of FIG. 6 in the direction indicated by the arrows.
Figure 8:
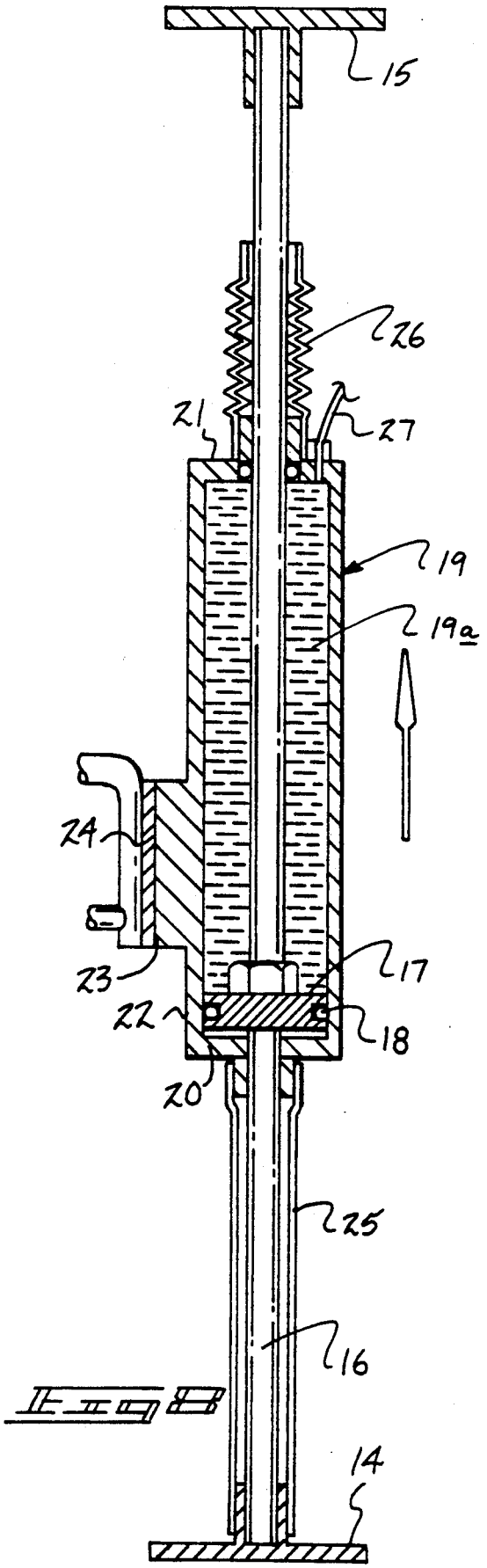
FIG. 8 is an orthographic cross-sectional illustration of the hydraulic cylinder in a raised orientation relative to FIG. 2.
Figure 9:
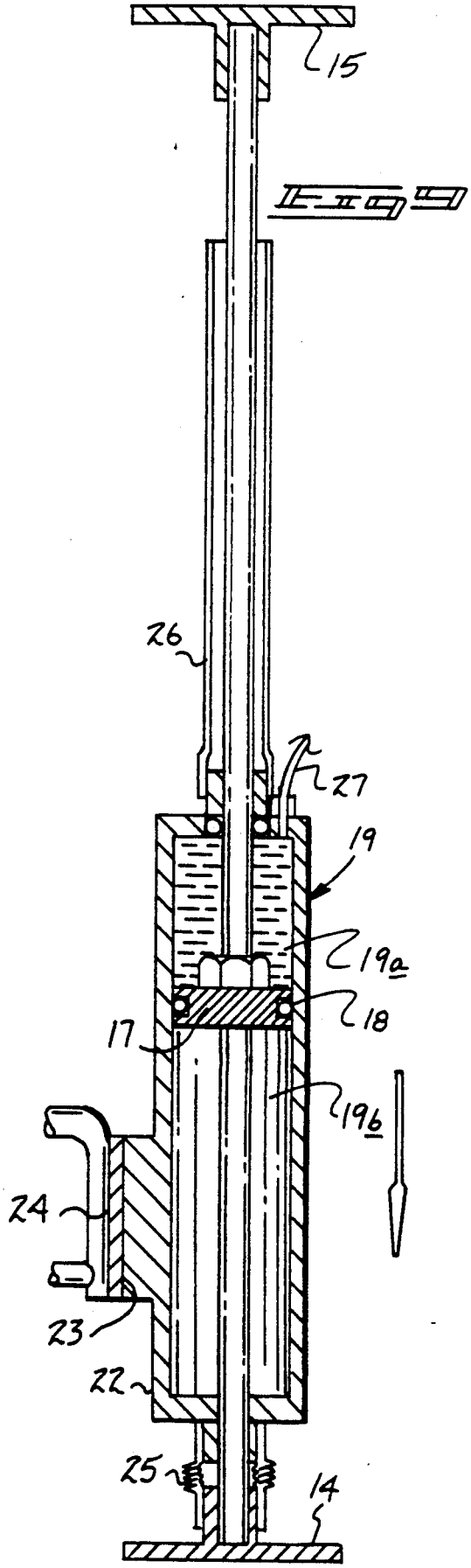
FIG. 9 is an orthographic cross-sectional illustration of the hydraulic cylinder in a lowered orientation relative to the orientation of the chair, as illustrated in FIG. 1.

Reference to the FIGS. 1-3 indicates that the mounting wall 24 of the lug 23 fixedly receives a mounting plate 39, having first and second support legs 40 and 41 that are oriented substantially orthogonally relative to the shaft 16, with the first and second support legs 40 and 41 mounting a seat frame 42 that in turn includes forward and rear leg brackets 43 and 44 that extend below the seat frame. First and second side rails 45 and 46 extend on opposed sides of an L-shaped seat 47 mounted upon a seat frame 42. Upon lifting of the seat to the raised or second position, the seat is then rotated about the shaft as the cylinder 19 is rotatably mounted about the shaft 16 permitting positioning of the individual into the bathtub cavity 13 upon release or exhausting of fluid from the upper chamber 19*a* within the cylinder 19. Lifting an individual from the bathtub cavity merely requires a reversal of the procedure relative to the positioning of an individual within the bathtub cavity 13.

Figure 10:
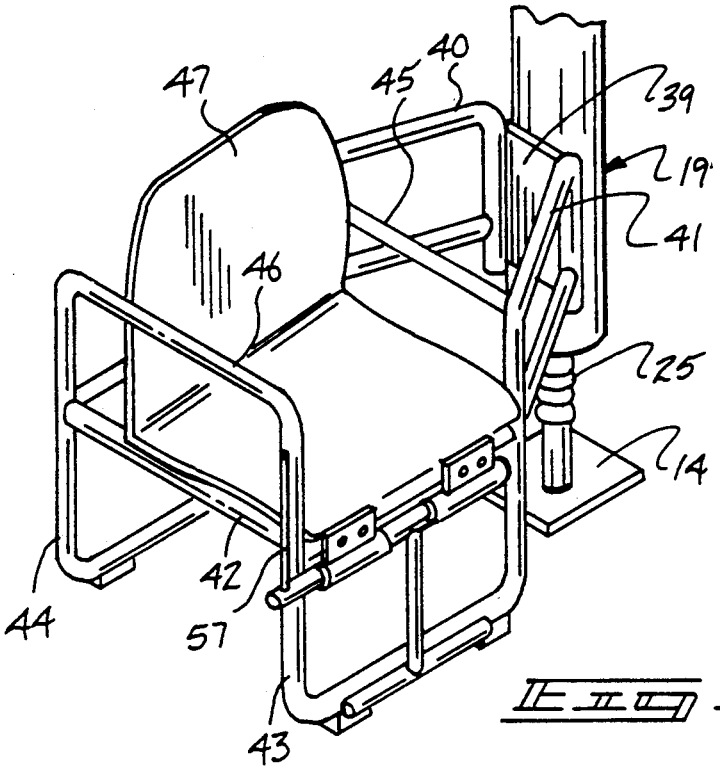
FIG. 10 is an isometric illustration of the chair structure employing a leg lift bracket.
Figure 11:
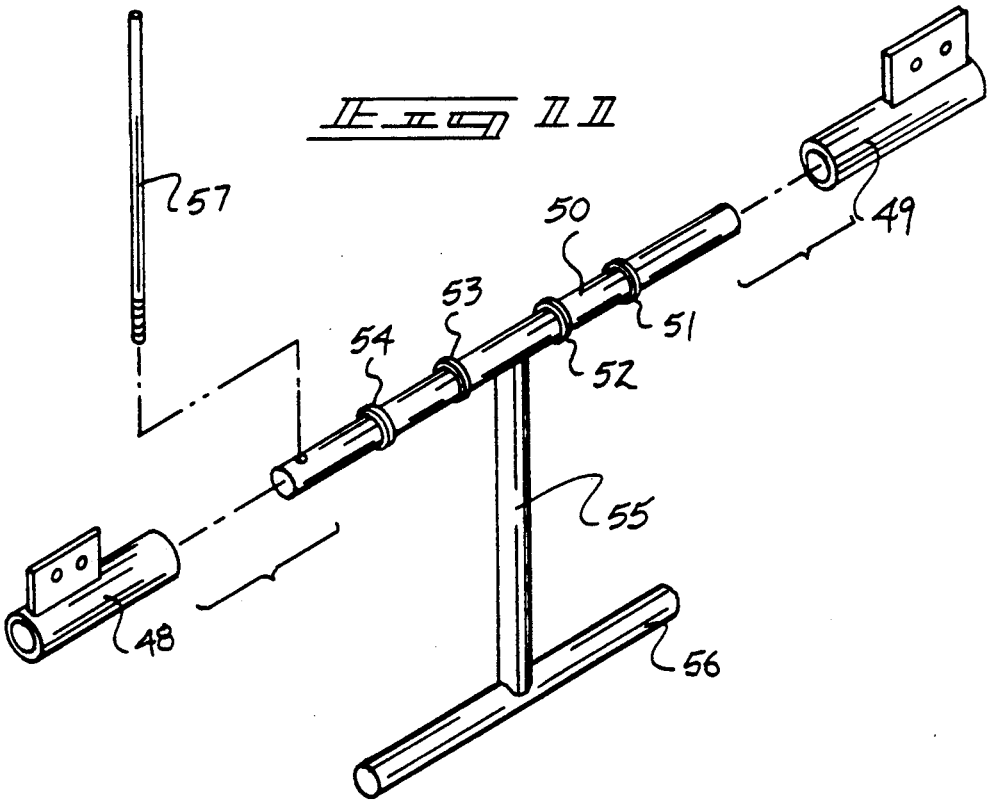
FIG. 11 is an isometric exploded view of the leg lift bracket employed by the chair as set forth in FIG. 10.

The FIGS. 10 and 11 indicates the use of a leg lift structure mounted to the forward leg bracket 43, having a first and second pivot tube 48 and 49 that are coaxially aligned relative to one another mounted in adjacency to the L-shaped seat 47 receiving a pivot rod 50 therebetween, wherein the pivot rod includes first and second abutment rings 51 and 52 positioned on opposed sides of the first pivot tube 48, while third and fourth abutment rings 53 and 54 are mounted on opposed ends of the second pivot tube 49. An extension rod 55 orthogonally and medially mounted to the pivot rod 50 extends to a leg lift rod 56 that is arranged parallel to the pivot rod 50, where an individual positions the handicapped person's legs over the leg lift rod 56 and upon rotation of a handle leg 57 that is mounted to the pivot rod 50 exteriorly of the second side rail 46, the leg lift rod 56 is raised and simultaneously lifts an individual's legs that is seated upon the L-shaped seat 47.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A handicap bathtub lift apparatus, comprising, a foot plate in a spaced relationship relative to a head plate, and a longitudinal shaft member extending fixedly between the foot plate and the head plate, with the shaft member having a piston plate fixedly mounted to the shaft member, and a reciprocatable cylinder mounted reciprocatably about the shaft member, with the piston plate positioned within the cylinder, and the cylinder having a bottom wall spaced from a top wall and a side wall, with the cylinder having an upper chamber positioned between the piston plate and the top wall, and a lower chamber positioned between the piston plate and the bottom wall, the side wall including a side wall lug having a mounting wall, and the mounting wall including a mounting plate fixed to the mounting wall, with the mounting plate including first and second support legs fixedly mounted to the mounting plate, with the first and second support legs orthogonally oriented relative to the shaft member, and the first and second support legs include a seat frame fixedly mounted to the first and second support legs spaced from the mounting plate, and the seat frame includes a forward leg bracket and a rear leg bracket, with the forward leg bracket and the rear leg bracket extending below the seat frame, and the seat frame including an L-shaped seat positioned thereon, and a cylinder conduit directed into the upper chamber through the top wall, and a fluid exhaust conduit, and a fluid pressure conduit, and control valve means in fluid communication between the cylinder conduit, the pressure conduit, and the exhaust conduit for selective projection of fluid pressure into the upper chamber to lift the cylinder from a first lower position to a second raised position.

2. An apparatus as set forth in claim 1 including a first protective bellows extending from the bottom wall to the foot plate, and a second protective bellows extending from the top wall to position in adjacency to the head plate.

3. An apparatus as set forth in claim 2 wherein the control valve means includes a control valve housing having a rotary valve hub contained therewithin, the rotary valve hub including a hub first conduit and a hub second conduit, with the first hub first conduit and the hub second conduit spaced apart one hundred twenty degrees, and the valve housing having a first port, a second port, and a third port directed into the valve housing, with the first port, the second port, and the third port spaced apart one hundred twenty degrees, with the cylinder conduit directed into fluid communication with the first port, the pressure conduit directed in fluid communication with the second port, and the exhaust conduit directed into fluid communication with the third port, with the hub arranged for rotation from a first position directing fluid communication between the first port and the second port through the first conduit and the second conduit, and permitting rotation of the hub to a second position directing fluid communication between the first port and the third port through the first conduit and the second conduit.

4. An apparatus as set forth in claim 3 including an arcuate slot directed into an interior wall of the valve housing, with the hub having a tang, and the tang received within the arcuate slot, and the slot having a first end and a second end, with the hub oriented in a first position when the tang is at a first end of the slot, and the hub positioned in a second position when the tang is in a second end of the slot.

5. An apparatus as set forth in claim 4 including a first pivot tube and a second pivot tube mounted to the forward leg bracket, with the first pivot tube and the second pivot tube coaxially aligned, and a pivot rod rotatably received within the first pivot tube and the second pivot tube, and the pivot rod having a first abutment ring and a second abutment ring positioned on opposed ends of the first pivot tube, and the pivot rod having respective third and fourth abutment rings mounted on opposed ends of the second pivot tube to longitudinally affix the pivot rod relative to the first pivot tube and the second pivot tube, and the pivot rod including an extension rod fixedly and orthogonally mounted medially of the pivot rod between the second abutment ring and the third abutment ring, and a leg lift rod fixedly and orthogonally mounted to the extension rod in a spaced parallel relationship relative to the pivot rod, and a handle leg fixedly and orthogonally mounted to the pivot rod exteriorly of the seat frame, whereupon rotation of the handle leg effects rotation of the pivot rod and rotation of the lift rod relative to the forward leg bracket to permit lifting of an individual's legs positioned within the seat.

* * * * *